United States Patent [19]

Mutchler

[11] Patent Number: 4,729,365

[45] Date of Patent: Mar. 8, 1988

[54] AIR HEATING APPARATUS AND METHOD

[75] Inventor: Paul A. Mutchler, University City, Mo.

[73] Assignee: Engineered Air Systems, Inc., St. Louis, Mo.

[21] Appl. No.: 887,229

[22] Filed: Jul. 21, 1986

[51] Int. Cl.[4] ..... F24H 3/02

[52] U.S. Cl. ..... 126/110 B; 126/116 R

[58] Field of Search ..... 126/104 A, 91 R, 91 A, 126/85 R, 85 B, 9 R, 72, 108, 248, 250, 104 R, 110 B, 99 A, 102, 116 R; 237/12.1, 12.3 R

[56] References Cited

U.S. PATENT DOCUMENTS

| | | | |
|---|---|---|---|
| 2,021,605 | 11/1935 | Macrae | 126/104 A |
| 2,844,195 | 7/1958 | Wein | 126/104 R X |
| 4,309,978 | 1/1982 | Hensiek et al. | 126/110 B |
| 4,471,754 | 9/1984 | Galtz | 126/110 B |
| 4,519,375 | 5/1985 | Galtz | 126/110 B |
| 4,545,329 | 10/1985 | Adams | 126/361 X |

FOREIGN PATENT DOCUMENTS

| | | | |
|---|---|---|---|
| 2101462 | 8/1972 | Fed. Rep. of Germany | 237/12.3 C |

*Primary Examiner*—Larry Jones

[57] ABSTRACT

An indirect fired air heater of the portable type and method of operating the same wherein the combustion gas flow is reversed in a combustion drum and passed through a heat exchanger between the drum and the outer casing, the heat exchanger being supported from the outer casing with the combustion drum floatingly supported therebetween.

17 Claims, 4 Drawing Figures

AIR HEATING APPARATUS AND METHOD

BACKGROUND OF THE INVENTION

The present invention relates to air heaters and more particularly to an indirect-fired air heater of the portable type suitable for field use to heat both personnel and equipment and a method of heating air.

It is generally well known in the portable heater art to provide a forced air heater which includes an outer casing having a smaller combustion drum disposed therein which defines a plurality of air heating passages extending through the heater between the drum and the casing, the heater including a blower to force air through the heating passages and a burner to direct flame in the combustion drum toward the downstream end where resulting gases are evacuated. More recently attempts have been made to eliminate the vanes and baffles required at the downstream end of the drum to obtain sufficient heat transfer and to eliminate concomitant pressure drop brought about by such vanes and baffles. In U.S. Pat. No. 4,309,978, more recently issued on Jan. 12, 1982 to Charles R. Hensiek et al, a portable heater structure was disclosed which reversed the combustion gas flow at the downstream end of the combustion drum to form a flow of hot combustion gases moving toward discharge ports at the upstream end of the combustion drum, thus more effectively utilizing the entire length of the heater for heat exchange purposes and obtaining complete combustion without corrosive carbon deposits within the drum. To accomplish this and at the same time support the combustion drum within the outer casing, a particular type of ribbed drum was provided with the ribs abutting the casing and sometimes leading to "hot spots" at the areas of abutment, gathering particulate matter and interfering with heat exchange flow. Further, the manufacturing and assembly steps required were often extensive and complex and hardly economical.

The present invention, recognizing the desirablity of reversing combustion gas flow at the downstream end of a combustion drum to form a flow of hot gases toward the upstream end of the combustion drum and at the same time recognizing the limitations of past structure to accomplish the same, provides an improved forced air heating apparatus which allows for the prompt and efficient heating of large volumes of air with a minimum of flow turbulence and pressure drop, assuring efficient utilization of radiant and convective heat energy and, at the same, requiring a minimum number of steps and parts in both manufacture and assembly. In addition, the present invention provides a novel method of supporting a combustion drum within the outer casing of a portable heater without sacrificing smooth, laminar heat exchange flow and without creating possible areas of undue wear, undesirable hot spots and unwanted crevices for particulate concentrations in the outer casing.

Various other features of the present invention will become obvious to one skilled in the art upon reading the disclosure set forth herein.

SUMMARY OF THE INVENTION

More particularly, the present invention provides an improved air heating apparatus comprising: a longitudinally extending outer casing having spaced air inlet and air outlet means; a combustion drum disposed within the casing, the drum being closed at one end and being sized to define a longitudinally extending flow-through passage between the drum and outer casing; burner means disposed in the drum; combustion air inlet means in the drum communicating with the burner means; combustion gas outlet means in the drum; combustion gas outlet means cooperating with the outer casing; heat exchange means disposed to extend along the flow-through passage in spaced relation between the drum and the outer casing to connect the combustion gas outlet in the drum with the combustion gas outlet means cooperating with the outer casing; blower means cooperatively positioned with respect to the outer casing to move air from the air inlet of the outer casing through the flow-through passage between the drum and outer casing to the air outlet of the casing to warm such moving air by the heat exchange means and the outer surface of the drum; and, support means to support the heat exchange means and the combustion drum in spaced relation in the outer casing. In addition, the present invention provides a method for heating ventilating air in a heater having a casing with a combustion drum disposed therein in spaced relation therefrom to create a flow-through passage around the drum, the drum having a closed downstream end and an upstream burner with a combustion gas header downstream of the closed downstream end of the drum comprising: directing a flame of combustion products toward the closed downstream end of the drum while evacuating the gases from the peripheral region of the drum at the upstream end of the drum to effect a reverse flow of combustion gases surrounding the flame within the drum at the upstream end of the drum; conducting the combustion gases in separate enclosed fluid communication through the flow-through passage between drum and outside casing to the header from the upstream end of the drum; and, moving an air stream through the flow-through passage in separate surrounding heat exchange relation with the enclosed fluid combustion gases. Further, the present invention provides a novel combustion gas header arrangement and a novel support arrangement for a combustion drum and cooperating heat exchange means.

It is to be understood that various changes can be made by one skilled in the art in one or more of the several parts of the novel apparatus disclosed herein and in one or more of the several steps of the disclosed method without departing from the scope or spirit of the invention.

BRIEF DESCRIPTION OF THE DRAWING

Referring to the drawings which disclose an advantageous embodiment of the present invention.

DETAILED DESCRIPTION OF THE DRAWING

Figure 1:
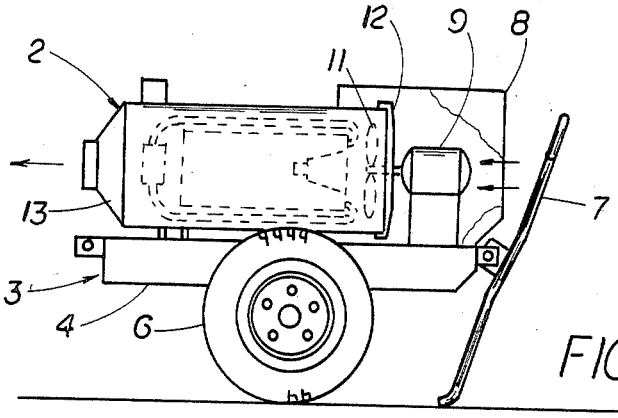
FIG. 1 is a side elevational view of an air heater embodying the invention mounted on a portable carriage.

As can be seen in FIG. 1 of the drawing, the inventive air heater 2 can be mounted on a trailer 3. Trailer 3 includes a base portion 4 which serves as the main fuel tank and is normally supported by a pair of wheels 6 and a movable handle or towbar 7. A suitable motor cowling 8 serves to house motor 9 which drives axial flow fan or blower 11 mounted on spider 12 at one end of the longitudinally extending, cylindrical outer casing 13 of the inventive heater 2. As known in the art and as illustrated by the flow arrows, venting air to be heated is drawn into cowling 8 and forced through outer casing 13 by axial flow fan or blower 11 driven by motor 9. In this regard it is to be understood that the present invention is not to be considered as limited to the portable arrangement heretofore described but that other trailer arrangements and other blower structures—such as a centrifugal blower—can be employed.

Figure 2:
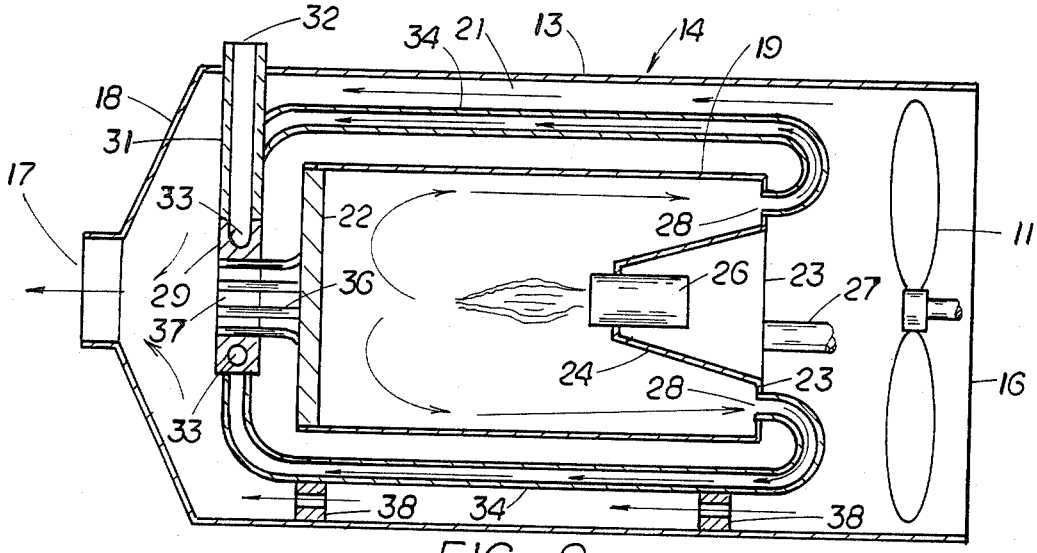
FIG. 2 is an enlarged cross-sectional schematic view of the outer casing, combustion drum and heat exchange arrangement of the invention.
Figure 3:
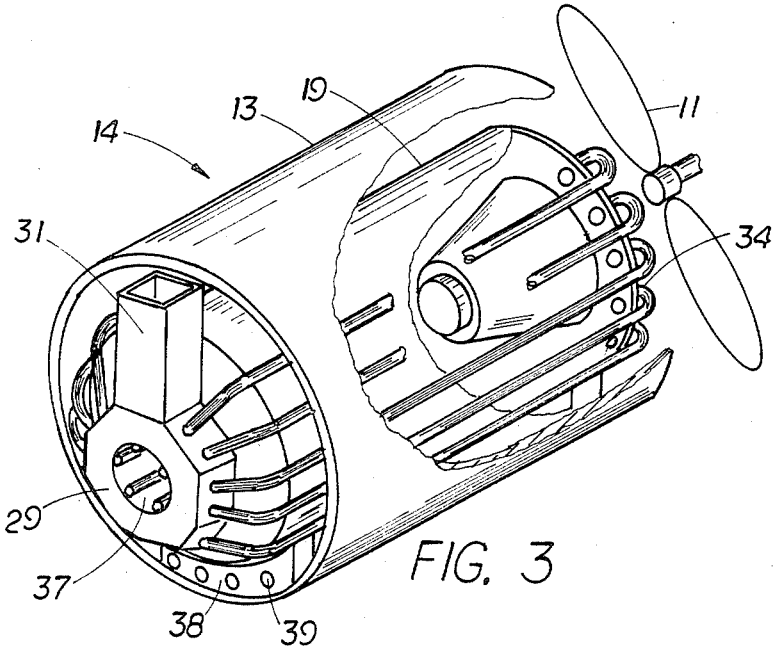
FIG. 3 is a further enlarged, partially broken away isometric view of the apparatus of FIG. 2; and, FIG. 4 is a broken, isometric view of a support cradle of FIG. 2.
Figure 4:
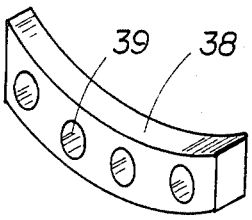

As can be seen in FIGS. 2–4, the longitudinally extending, cylindrical outer casing 13 includes a cool air inlet 16 between the radially extending spokes of spider 12 at one end thereof and a warm air outlet 17 at the opposite end thereof at the end of truncated evase 18 of outer casing 13. Disposed completely within cylindrical casing 13 is a longitudinally extending cylindrical combustion drum 19. Drum 19 is sized in cross-section relative the cross-section of outer casing 13 to be substantially smaller so as to define a flow-through annular passage 21 therebetween. As can be seen in FIG. 2, the downstream end of combustion drum 19 closest to warm air outlet 17 of outer casing 13 is closed at 22 by a suitable fire wall.

Disposed within combustion drum 19 at the upstream end wall 23 is a generally frusto-conical chamber defining wall 24 coaxially aligned with the longitudinal axis of drum 19. A burner tube 26 is positioned to extend through the apex portion thereof to accommodate delivery of an axially directed flame or jet of combustion products into drum 19 toward wall 22. Although not disclosed in detail herein, burner tube 26 can include an appropriate nozzle and one or more openings (not shown) to meter a flow of venting air into the burner and drum to support the combustion process. In this regard, a suitable igniter (also not shown) can be employed to initiate combustion in the chamber and at the burner. As can be seen in FIG. 2, a combustion air inlet tube 27 communicating with the combustion chamber defined by frusto-conical wall 24 serves to introduce the necessary combustion air into the chamber. Adjacent the base of the frusto-conical chamber defining wall 24 in the upstream end wall 23 of drum 19 are a plurality of spaced combustion gas outlet openings 28 extending in spaced relation therearound.

Disposed downstream within outer cylindrical casing 13 in spaced relation downstream of fire wall 22 which closes the downstream end of drum 19 is an annular exhaust header 29. Annular header 29 is connected by an exhaust conduit or stack 31 to an exhaust outlet 32 in casing 19. The peripheral wall of stack 31 can be fixed to the wall of casing 19 at outlet 32 by some suitable means such as welding. Annular header 29 is provided with a plurality of spaced openings 33 therein along the outer peripheral wall thereof corresponding in number to the spaced gas outlets 28 in upstream drum end wall 23. A plurality of spaced heat exchange tubes 34 are arranged to extend in spaced relation intermediate the flow-through annular passage 21 defined by outer casing 13 and drum 19, each of these tubes 34 is so turned at its opposite extremities, that one end of each tube is connected to a combustion gas outlet 28 in upstream end wall 23 of drum 19 and the other end is connected to one of the spaced openings 33 in the outer peripheral wall of annular header 29. It is to be noted that axial fan or blower 11 is so positioned in outer casing 13 adjacent the upstream drum end wall 23 of drum 19 to move air through flow-through annular passage 21 surrounding heat exchange tubes 34 from upstream air inlet 16 in outer casing 13 to spaced downstream air outlet 17 of casing 13 substantially in the same flow direction as the flow of combustion gases in heat exchange tubes 34.

To support burner tubes 34 and combustion drum 19 in spaced relation to outer casing 13, the downstream end wall 22 of drum 19 has a plurality of spaced rod members 36, each fixed at one end to end wall 22 to extend in cantilever fashion and matingly engage in the central passage 37 defined by annular header 28 with the inner passage defining wall resting thereagainst. It is to be understood that instead of rod members 36 a suitable tube which can be appropriately perforated to permit air passage therethrough can be fixed at one end to wall 22 to extend in cantilever fashion therefrom and matingly engage with passage 37 at the opposite end thereof.

To further support burner tubes 34 and combustion drum 19 in the desired position relative outer casing 19, suitable support cradles 38 (FIG. 4) can be appropriately mounted in spaced relation at least on the lower section of the inner wall of casing 19 with lower tubes 34 nesting thereon. Advantageously, neither cantilevered rods 36 mating with passage 37 in annular header 29 nor tubes 34 nesting with cradles 38 are fastened thereto, thus allowing the tubes 34 and drum 19 to be floatingly supported and accommodating for the expansion and contraction which would occur during heating and cooling. It is to be noted that cradles 38 are appropriately provided with spaced apertures 39 to permit venting air to be heated by tubes 34 in annular passage 21 to flow therethrough.

In a typical operation of the above described apparatus, combustion products are directed in axial flow from burner 26 toward downstream end firewall 22. The flow reverses itself to form an annular flow of combustion gases surrounding the combustion products directed from the burner 26, moving toward the upstream end of the combustion drum 19 and guided by truncated frusto-conical wall 24 through gas outlets 28. In this regard, it is to be noted that this reversal of combustion gases in drum 19 serves to recirculate unburnt fuel until more complete combustion is obtained and to thus abate development of pitting and corrosive carbon deposits. From gas outlets 28 in the upstream end wall 23 of drum 19, the combustion gases are conducted by heat exchange tubes 34 in separate enclosed fluid communication through the annular flow-through passage between the combustion drum 19 and the outer casing 13 toward the downstream annular header 29. At the same time blower 11 driven by motor 9 moves a venting air stream through flow-through annular passage 21 in separate surrounding heat exchange relation with the enclosed fluid combustion gases and the drum 19, the venting air flowing in the same direction toward the downstream end of casing 13 and warm air outlet 17 as the direction of flow of combustion gases toward downstream annular header 29. It is to be noted that a portion of the venting air at the downstream end of drum 19 flows between fire wall 22 and header 29 through the central passageway 37 of the header to efficiently effect a thermal buffer between fire wall 22 and header 29 and along the central portion of header 29 as well. This buffer serves to efficiently retard reheating of combustion gases and, at the same time, enhancing heat transfer to the venting air as it moves toward downstream air outlet 17. It is to be noted that the floating support of the heat exchanger tubes 34 and combustion drum 19 by cantilever rod members 36 and cradles 38 serves to accommodate for expansion and contraction of such parts as the temperatures increase and decrease therein.

The invention claimed is:

1. An improved air heating apparatus comprising:

a longitudinally extending outer casing having spaced air inlet and air outlet means;

a combustion drum disposed within said casing, said drum being closed at one end and being sized to define a longitudinally extending flow-through passage between said drum and said outer casing;

burner means dispossed within said durm;

a combustion air inlet means in said drum communicating with said burner means;

at least one combustion gas outlet in said drum;

at least one combustion gas outlet cooperating with said outer casing;

heat exchange means disposed to extend along said flowthrough passage in spaced relation between and to both said drum and said outer casing, said heat exchange means including an exhaust header to connect said combustion gas outlet in said drum with said combustion gas outlet cooperating with said outer casing;

blower means cooperatively positioned with respect to said outer casing to move air from said air inlet of said outer casing through said flow-through passage between said drum and said outer casing to said air outlet of said casing to warm such moving air by said heat exchange means and the outer surface of said combustion drum; and, support means to support said heat exchange means and said combustion drum to allow relative movement thereof in spaced relation in said outer casing.

2. The air heating apparatus of claim 1, said support means supporting said heat exchanger, with said combustion drum being supported at the opposite ends thereof to said heat exchanger with at least one of said ends of said drum being moveably supported relative said heat exchanger exhaust header.

3. The air heating apparatus of claim 1, said burner means being positioned at the end of said combustion drum opposite said closed end thereof.

4. The air heating apparatus of claim 1, said burner means including a frusto-conical combustion chamber disposed within said combustion drum at the end opposite said closed end and a burner tube extending through the apex portion thereof.

5. The air heating apparatus of claim 1, said heat exchange means comprising a plurality of tubes extending from said combustion gas outlet at one end of said combustion drum to said combustion gas outlet cooperating with said outer casing proximate the other end of said drum.

6. The air heating apparatus of claim 1, said combustion gas outlet in said drum comprising a plurality of spaced gas outlet openings at one end of said combustion drum;

said heat exchange means comprising a plurality of tubes, each of which has one end connected to one of said combustion gas outlet openings in said drum, the other end of each of said tubes being connected to said combustion gas outlet cooperating with said outer casing positioned at the other end of said combustion drum, said combustion gas outlet cooperating with said outer casing being connected to said exhaust header to which said other tube ends are connected.

7. The air heating apparatus of claim 1, said support means to support said heat exchange means including at least one support cradle mounted in the lower section of said outer casing.

8. The air heating apparatus of claim 1, said combustion drum including at least one support member extending in cantilevered fashion from one end of said combustion drum to slidably engage with said heat exchanger exhaust header to be supported therefrom.

9. The air heating apparatus of claim 1, said blower means being positioned in said outer casing to move air substantially in the same flow direction as the flow of combustion gas said heat exchange means.

10. The air heating apparatus of claim 1, said blower being an axial type.

11. The air heating apparatus of claim 1, said blower being a centrifugal type.

12. The air heating apparatus of claim 1, said combustion drum and said outer casing being of cylindrical shape to define an annular air flow passage therebetween.

13. The air heating apparatus of claim 1, said combustion gas outlet cooperating with said outer casing being connected to said exhaust header spaced from said closed end of said drum to permit air passing to said outlet to surroundingly flow around said exhaust header.

14. An improved air heating apparatus comprising:

a longitudinally extending cylindrical outer casing having an air inlet at one end thereof and an air outlet at the other end thereof;

a longitudinally extending cylindrical combustion drum disposed within said outer casing, said drum being sized relative said casing to define a flow-through annular passage therebetween and having the end closest to said air outlet of said outer casing closed;

a frusto-conical combustion chamber wall disposed with said combustion drum at the end opposite said closed end including a cylindrical burner tube extending through the apex portion thereof;

a combustion air inlet tube communicating with said frusto-conical combustion chamber;

a plurality of spaced combustion gas outlet openings in said combustion drum extending in spaced relation around the base of said frusto-conical combustion chamber;

an annular exhaust gas header disposed within said outer casing spaced from said closed end of said combustion drum, said header being connected by an exhaust gas conduit to an exhaust gas outlet in said outer casing;

a plurality of spaced heat exchange tubes longitudinally extending in said flow-through annular passage between said outer casing and said combustion drum to surround said drum, one end of each tube being connected to a combustion gas opening in said combustion drum and the other end to said annular exhaust gas header;

an axial blower positioned in said outer casing to move air through said flow-through passage from said air inlet in said outer casing to said spaced air outlet of said casing substantially in the same flow direction as the flow of combustion gas in said heat exchange tubes;

a support member extending from the closed end of said combustion drum to slidably and matingly engage in the passage defined by said annular exhaust header; and, a support cradle mounted in the lower section of said outer casing to nestingly and supportively receive the lower of said heat exchange tubes to thus floatingly support said combustion drum surrounded thereby.

15. A method for heating ventilating air in a heater having a casing with a combustion drum disposed therein in spaced relation therefrom to create a flow-through passage around the drum, the drum having a closed downstream end and an upstream burner with a combustion gas header downstream of the closed downstream end of the drum comprising:

directing a flame of combustion products toward the closed downstream end of said drum while evacuating said gases from the peripheral region of the drum at the upstream end of said drum to effect a reverse flow of combustion gases surrounding the flame within said drum at the upstream end of said drum;

conducting said combustion gases in separate, enclosed fluid communication passages through said flow-through passage between and in spaced relation with both said drum and said outside casing to said header from the upstream end of said combustion drum;

moving an air stream through said flow-through passage in separate surrounding heat exchange relation with said enclosed fluid combustion gases and;

supporting said fluid communication passages to allow relative movement thereof.

16. The method of heating ventilating air of claim 15, including moving said air stream through said flow-through passage in the same direction of flow as said combustion gases.

17. The method of heating ventilating air of claim 15, including conducting said combustion gases in said header along an enclosed annular passage and diverting a portion of said ventilating air to surround said enclosed annular passage to retard reheating of the combustion gases prior to atmospheric discharge through said outer casing.

* * * * *